US008534329B2

(12) United States Patent
Grisley

(10) Patent No.: US 8,534,329 B2
(45) Date of Patent: Sep. 17, 2013

(54) JOINT MAKING JIG

(75) Inventor: Kenneth McLean Grisley, British Columbia (CA)

(73) Assignee: Leigh Industries, Ltd. (CA)

( * ) Notice: Subject to any disclaimer, the term of this patent is extended or adjusted under 35 U.S.C. 154(b) by 192 days.

(21) Appl. No.: 12/958,919

(22) Filed: Dec. 2, 2010

(65) Prior Publication Data

US 2012/0138193 A1 Jun. 7, 2012

(51) Int. Cl.
*B27C 5/00* (2006.01)

(52) U.S. Cl.
USPC ..... 144/144.1

(58) Field of Classification Search
USPC ..... 144/144.51, 144.52, 145.1, 144.1
See application file for complete search history.

(56) References Cited

U.S. PATENT DOCUMENTS 2,605,790 A * 8/1952 Schwarzer ..... 144/27
5,711,356 A * 1/1998 Grisley ..... 144/144.51
5,890,524 A * 4/1999 Tucker et al. ..... 144/371
5,983,968 A * 11/1999 Newman ..... 144/372
6,076,575 A * 6/2000 Harkness ..... 144/144.1
6,530,302 B1 * 3/2003 Rogers ..... 83/452
7,703,488 B1 * 4/2010 Douglas ..... 144/144.1
2003/0196726 A1 * 10/2003 Tucker et al. ..... 144/372
2009/0272463 A1 * 11/2009 Smith ..... 144/144.52

OTHER PUBLICATIONS

Prazi USA, www.prazi.usa.com, the Unique and Versative Joinery System, undated, 1 pg.

* cited by examiner

*Primary Examiner* — Dana Ross
*Assistant Examiner* — Matthew G Katcoff
(74) *Attorney, Agent, or Firm* — Kilpatrick Townsend & Stockton LLP

(57) ABSTRACT

A woodworking joint cutting jig comprised of a dovetailing template repositionably attachable to a beam, together with a side stop, a template, and a plurality of removable pin plates that establish positions along the beam for attachment of the template.

18 Claims, 14 Drawing Sheets

JOINT MAKING JIG

FIELD OF THE INVENTION

This invention relates to methods and apparatus for guiding a woodworking power tool used to cut joint members in wood workpieces. In particular, the device of the present invention is a template intended for making dovetail and similar joints.

BACKGROUND

Wooden boxes, drawers and storage chests, and a variety of other wooden furniture and objects, often use dovetail joints as a means of securely assembling components. A dovetail is a joint, usually right angled, formed of one or more projecting parts, i.e., tenons or pins, that fit tightly within corresponding recesses, i.e., mortises or gaps between tails, to form a joint. The pin is typically broader at its end than at its base. Dovetail joints are considered by most cabinet makers to be the strongest and most permanent joint typically made in cabinet making. A dovetail joint is generally employed in articles made of thinner materials such as drawers, boxes, chests, and the like.

Dovetails are used for both their decorative appearance and their high strength. Such joints can be made without industrial machinery in one of two principal ways, either using hand tools such as saws and chisels, or using power tools such as a router. In both cases, making such a joint requires a high degree of skill and precision. Furthermore, making such a joint using hand tools is time consuming. The desire to save time motivates most woodworkers to use power tools, and the need for precision, often in the relative absence of skill, makes jigs or machines that control the power tools desirable.

The use of a power tool such as a router allows two different approaches. The router can be held stationary and the workpiece moved relative to the position of the router, or the workpiece can be held stationary and the router moved relative to the workpiece. Additionally, in a variation of both basic approaches, both the router and the workpiece may move.

The modern electric router has made this process much easier with the help of router cutters, holding fixtures and templates. With fixtures, the workpiece is clamped into the fixtures and machined after the template location is set.

Most dovetail and other joint-making jigs utilize an array of "fingers" to guide a router cutter during engagement of the workpiece or workpieces to remove waste material and leave "pins" on one work piece and "tails" on the other work piece. The array of fingers are typically provided in one of two ways. In the first alternative template structure, a machined plastic or metal template has multiple fingers, each of which has a fixed position relative to other fingers on the template. In the second alternative, fingers are attached to and can be moved relative to each other on a finger-carrying plate, which facilitates manufacture of joints with variably spaced pins and tails rather than ones that are spaced only the predetermined amounts required by the machined template.

Prior art fixtures and templates are costly. Smaller versions may be less expensive, but they limit the width of workpieces. This suggests a need for a jig that is less costly than current jigs, can adapt to different sized workpieces, and that includes a template that can be used quickly and efficiently to cut joint members of various shapes and dimensions.

SUMMARY

Embodiments of this invention are jigs that facilitate cutting dovetail and other wood joints such as box joints or rounded shaped joints.

This jig uses a template that supports and guides an electric router to cut joint members in the workpieces. A locating structure facilitates moving the template with respect to the workpiece a pre-determined distance between a first position to cut joint members on the work pieces, and a second position to cut additional joint members on the workpieces. The jig also has a side stop and a plurality of pin plates that accurately position the template with respect to the workpiece.

The template is provided with multiple sets of guide fingers that guide the electric router. Each set of guide fingers is shaped and dimensioned to permit cutting of a particular size of joint member. In one embodiment, the template comprises more than one set of guide fingers.

Alternative arrangements of the template guide fingers are possible. For example, other embodiments of templates are disclosed in U.S. Pat. Nos. 5,711,356 and 5,114,265, where the templates are slidably attached to a bar, which patents are incorporated herein by reference. A pin positions the prior art template on the bar in two locations in the X axis to provide the correct offset for two mating boards. Additional holes in the template allow for other X axis positions used to make box joints that are half or a quarter the size of the array of fingers. The Y axis positioning for these templates and finger assemblies relative to the jigs' clamp face is provided by the sliding scales on the jig support brackets. In an embodiment on conventional bench mounted type jigs, a box joint template can have the X axis positioning holes at one end of the active front array of fingers and a matching low tolerance slot at the other end.

The present invention can be incorporated into various types of jig arrangements. The present invention uses fixed pins spaced apart on a beam, on jig brackets, or on the jig frame, either on conventional bench mounted type jigs, on purpose-made router table jigs or, in the case of the beam model, either 'upside-down' on a router table or 'right side up' using a hand held router.

On beam type jigs, the relatively short and lower cost template is "stepped over" with absolute precision from No's 1 & 2 pins to No's 2 & 3 pins, and so on. This concept lends itself to a 'kit' version because precise X and Y axis positioning of steel plates and index pins on a beam is achieved by use of integral set-up holes in the template, permitting the user to check and precisely adjust the pin plate positions through screwdriver access holes as necessary to correct for any beam expansion or contraction that may occur between uses. This jig may be used right side up for hand routing or upside down on a router table.

On each conventional bench mounted and beam type jig, the fixed jig pins and additional template holes provide precise X axis template offsetting for mating box joints as well as half and quarter size joints.

Among other attachment alternatives, templates can be attached to the steel pin plates by powerful rare earth magnets set flush with, or just below the template surface, by mechanical means such as sliding clips on the router table jig, or by turnbuckle clips. The indexing pins restrain movement of the templates horizontally, creating a very secure set-up that is quick and easy to use.

The indexing pins also provide precise Y axis template positioning (relative to the jig front face) for routing through dovetail pins. The through dovetail pin mode has Y axis control holes that step the assemblies in or out relative to the clamp face to allow for routing different sized through dovetail pin guides to match the dovetail bit socket.

Moving the template with respect to fixed workpiece positioning members requires no adjustment of the positioning members or workpieces. This allows for more accurate and faster cutting of the joints. For workpieces wider than the template, the present invention allows the user to simply move the template over or move the beam and workpiece over.

This invention therefore provides a versatile joint making machine for use with a router to make woodworking joints. The machine of this invention is accurate, easy to use, and easy to set up for making a wide range and variety of different joints. Other advantages and benefits of this invention will be apparent from the drawings and the following description of the invention and claims. This invention provides a dovetailing jig assembly that includes a dovetailing jig removably attachable to a workpiece, a scab board that abuts the workpiece, and a backup board, supporting the scab board removably attached to the jig. The jig may include a side stop, a template, and a plurality of removable pin plates that variably position the template with respect to the workpiece.

DETAILED DESCRIPTION OF THE DRAWINGS

Figure 1:
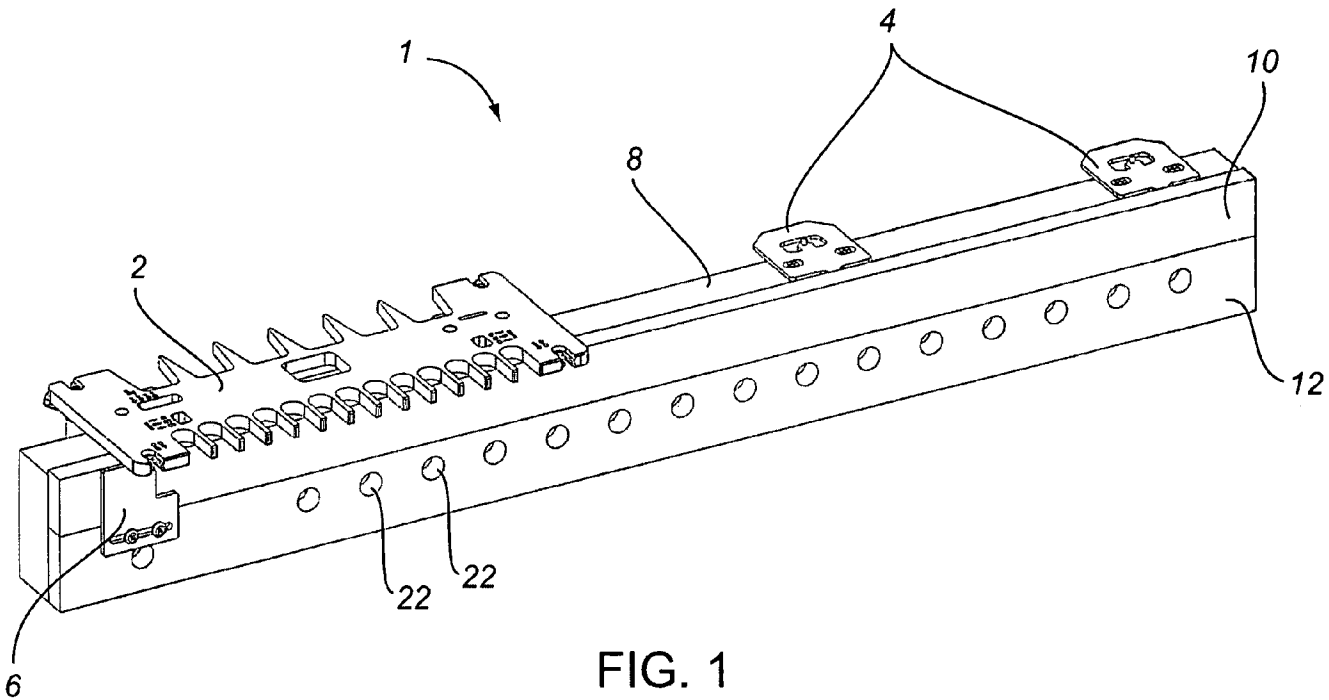
FIG. 1 is an isometric view of the tail face, top, and one end of a first embodiment of the woodcutting jig of this invention shown mounted on a positioning beam and scab board.
Figure 13:
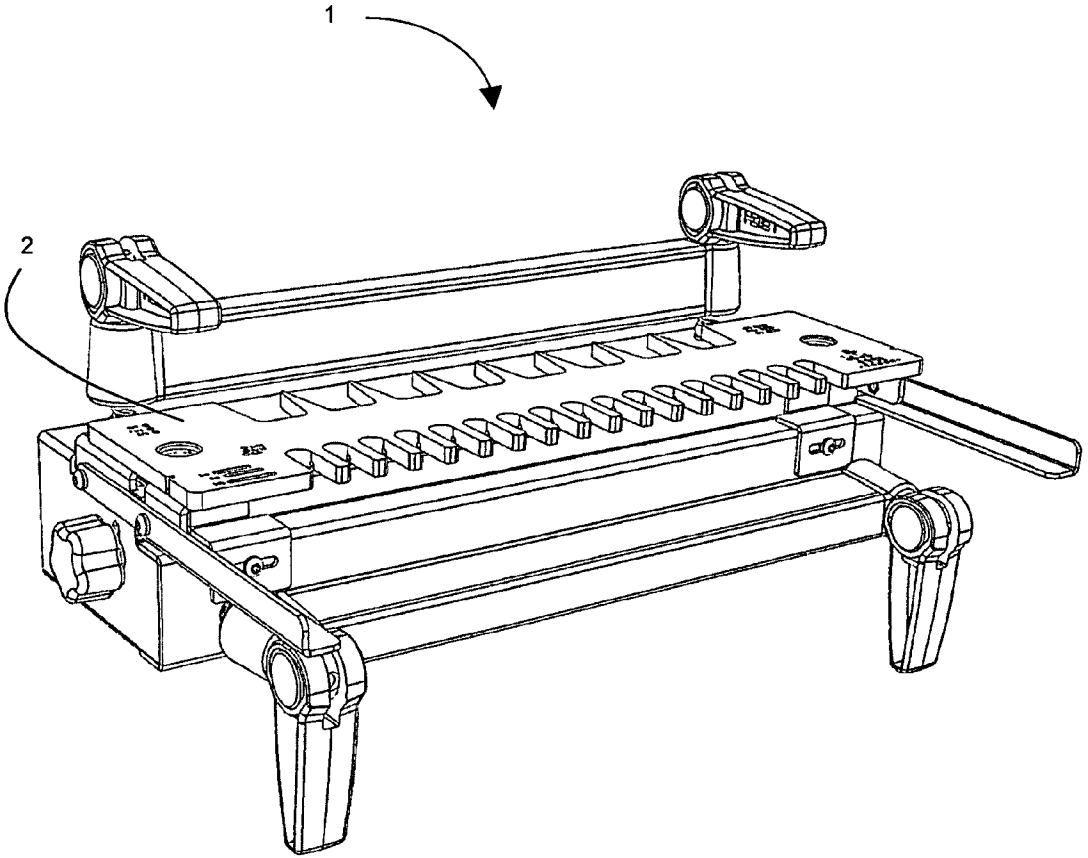
FIG. 13 is a view of another embodiment of the woodcutting shown in FIG. 1.

The woodcutting jig 1 of this invention, shown in FIG. 1, is used for securing workpieces and providing a path for an electric router to cut joint members in wood workpieces. A workpiece is temporarily secured by clamping the workpiece to a backup board and scab board. A cutter positioned in an electric router is then guided by the template 2 to cut pins and tails in the workpiece. Jig 1 has six components: template 2, positioning members 4, side stop 6, beam 8, scab board 10, and backup board 12. Alternatively, the woodcutting jig 1 may be used as a bench mounted jig as shown in FIG. 13.

Figure 12:
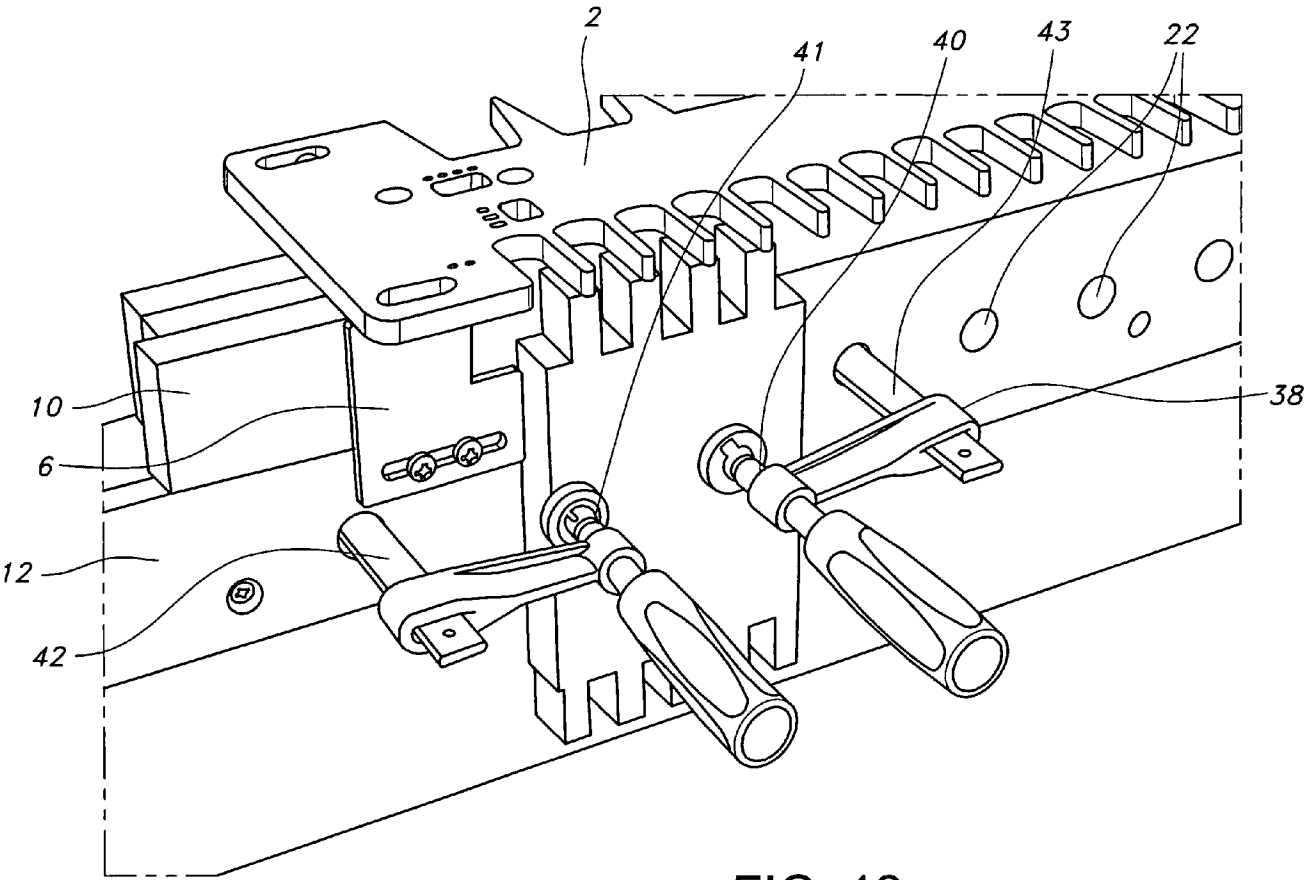
FIG. 12 is a view of the woodcutting jig shown in FIG. 1 with two clamps securing the workpiece for cutting box joints.

A workpiece is positioned against backup board 12 and scab board 10, as is depicted in FIG. 12, with a finger joint patterned template. The work piece is generally a rectangular board and clamps 38 secure the workpiece against backup board 12. In the embodiments in FIGS. 1 and 12, backup board 12 and beam 8 have a row of evenly spaced clamp holes 22 that can be used to attach clamps 38. Jaws 40 and 41 of clamp 38 bear against the front face of backup board 12, and the clamp bars 42 and 43 to which the jaws 40 and 41 attach pass from the rear through the holes 22 in beam 8 and backup board 12. Clamps 38 hold the workpiece against the scab board and backup board. After the workpiece is secured in place, a router (not shown) is used to cut pins and tails in the workpieces using a straight cutter for the pins and a dovetail shaped cutter for dovetail shaped tails.

Figure 5:
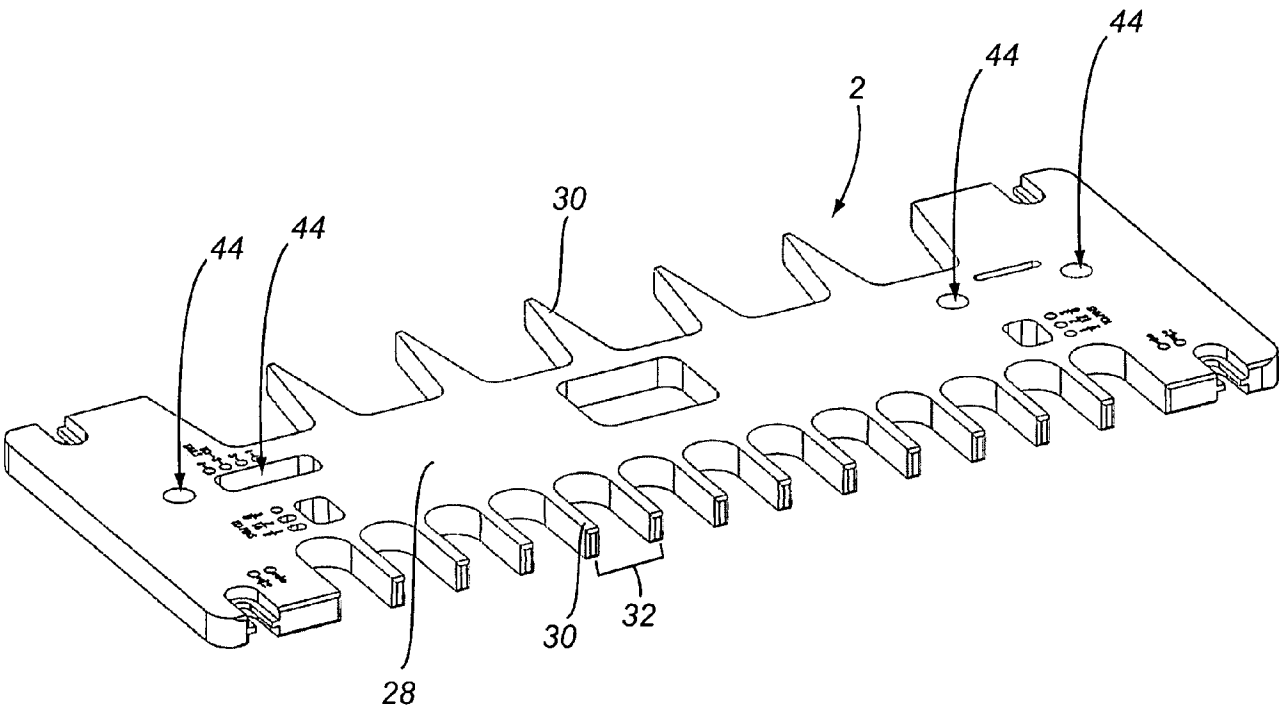
FIG. 5 is an enlarged isometric view of the template shown in FIGS. 1 and 4.
Figure 10A:
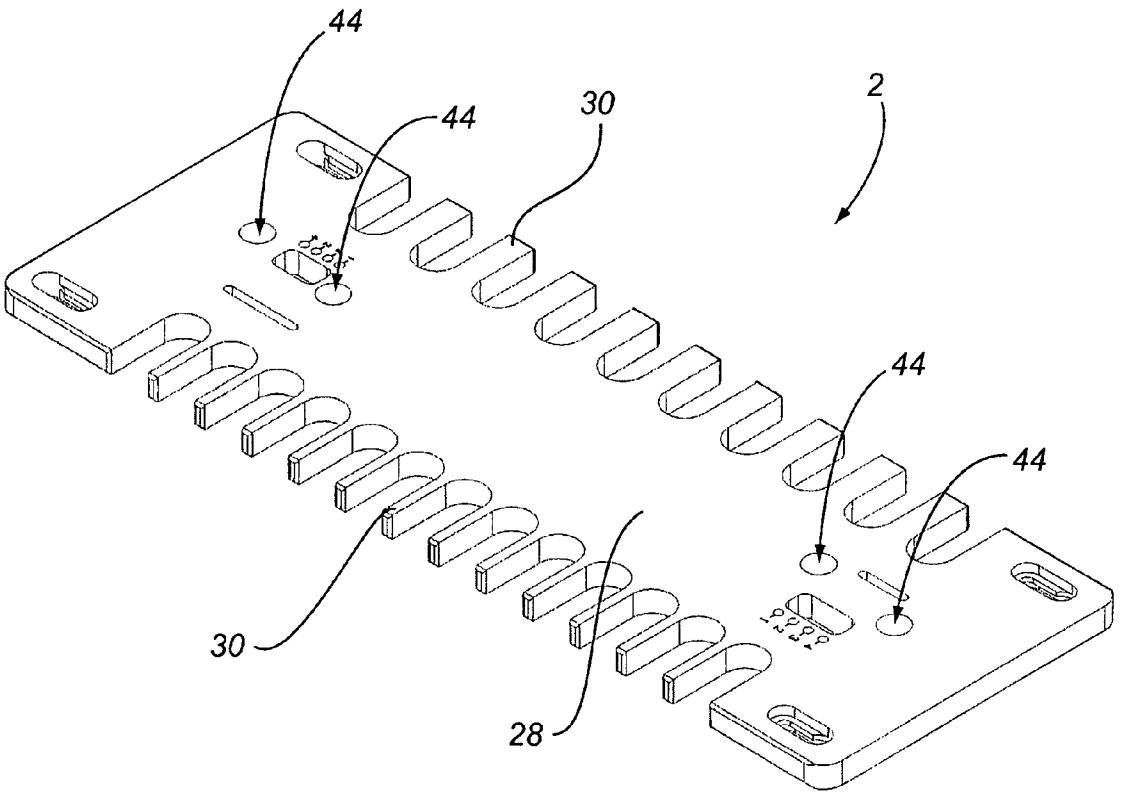
FIGS. 10A and 10B are views of different embodiments of the template.
Figure 10B:
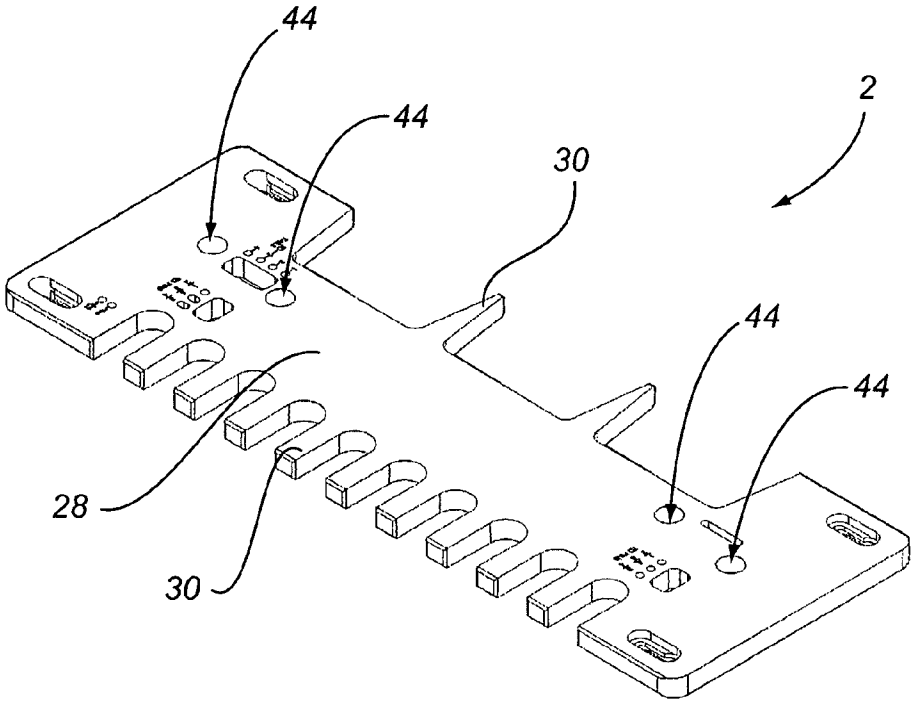

The path of the router is restricted by template 2. The template 2, depicted in FIG. 5, is relatively short and costs less than longer prior art templates. Template 2 has a planar surface 28 for supporting a cutting tool reference surface, such as a conventional electric router base, to cut joint members in workpieces positioned below template 2. Template 2 is formed with at least one set of protruding uniform fingers 30 defined by one or more surfaces orthogonal to the planar surface 28. A bushing mounted in an electric router base, or a bearing on the shank of a router cutter, (typically above the cutter blades) bears against the finger-defining surface to guide the cutting tool. Fingers 30 are spaced apart from adjacent fingers at a distance 32 equal to the pitch of the joint members to be cut, nominally twice the diameter of the router cutter. The design of the template allows other sets of guide fingers 30 to be formed on planar surface 28. Every set of guide fingers 30 is spaced and dimensioned to form joint members of a pre-determined pitch and size. Other embodiments of template 2 are shown in FIGS. 10A and 10B. Other embodiments of template 2 allow the cutting tool to vary the style and design of pin cuts and tail cuts, creating other dovetail joints.

As the pin and tail cuts are made, scab board 10, positioned under template 2 and abutting the workpiece, will be breached by the cutting tool. Scab board 10 is a replaceable board that can be removed without upsetting the positions of the other components by sliding scab board 10 longitudinally into or out of the jig assembly 1 between positioning beam 8 and side stop 6.

Figure 2:
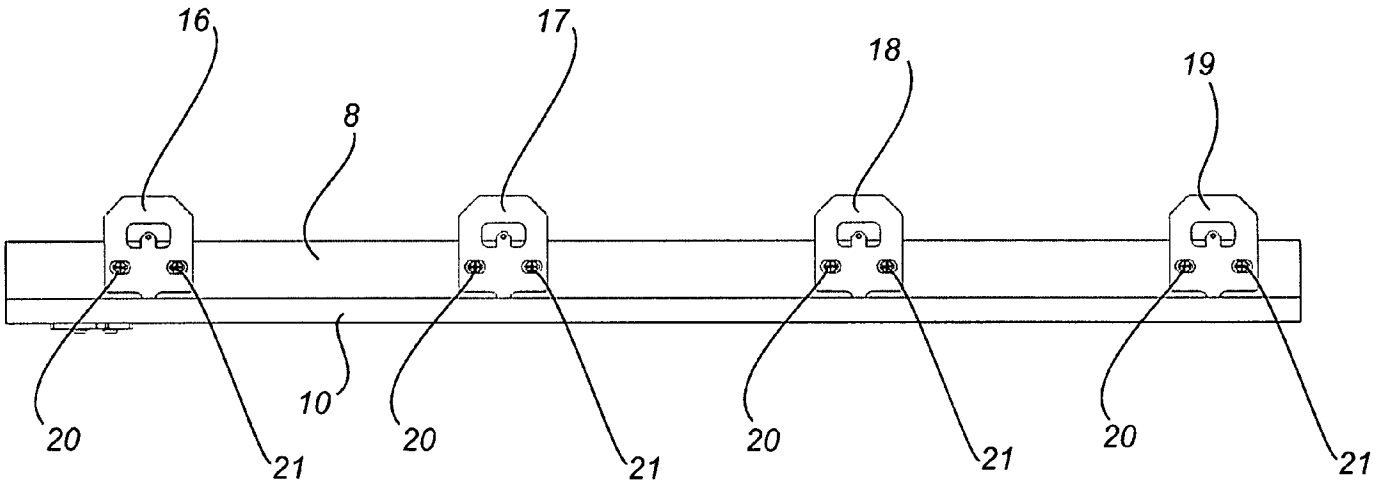
FIG. 2 is a top plan view of the woodcutting jig shown in FIG. 1 with the template removed.
Figure 3:
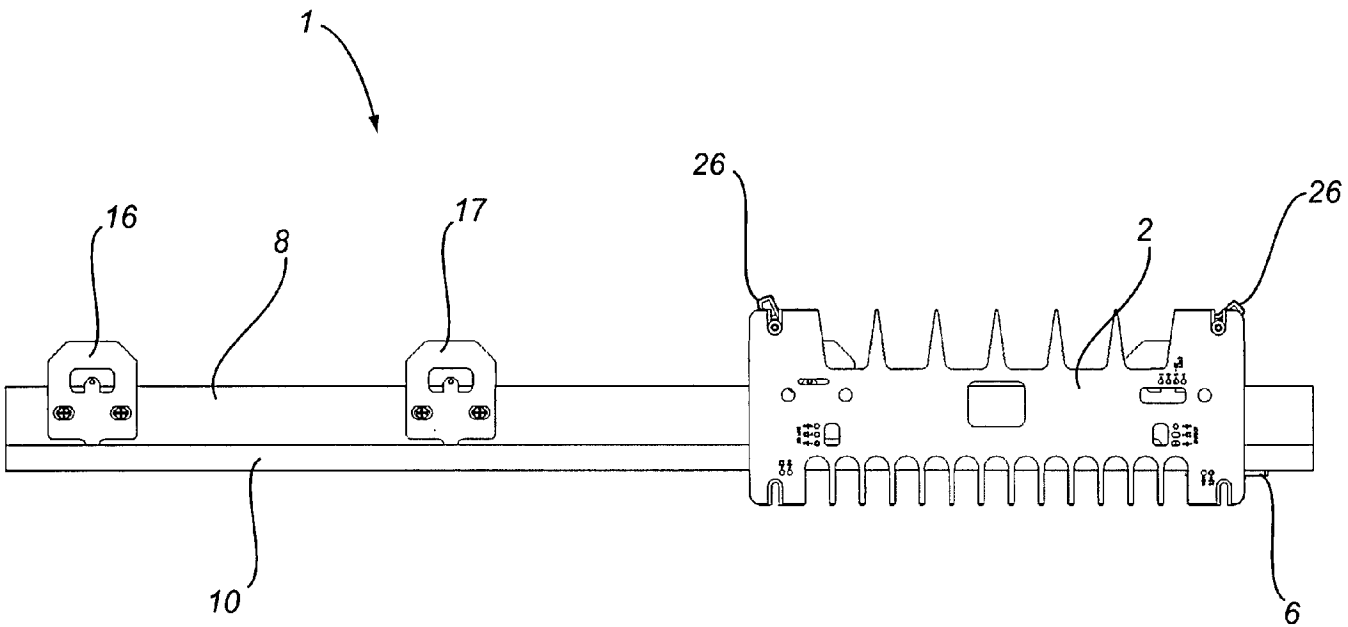
FIG. 3 is a top plan view of the woodcutting jig shown in FIG. 1.

Scab board 10 and/or backup board 12 may be made of medium-density fiberboard, an engineered wood product formed by breaking down softwood into wood fibers, combining it with wax and a resin binder, and forming panels by applying high temperature and pressure.

Where the workpiece is wider than template 2, template 2 can be "stepped over" to accurately cut the pins and tails In FIG. 2, beam 8 and scab board 10 are shown with four pin plates, 16, 17, 18, 19. Fewer or more pin plates can be used depending on the width of the workpiece. As shown in FIG. 2, pin plates 16, 17, 18, 19 are spaced equal distances apart on positioning beam 8. Anchoring screws 20, 21 secure each pin plate 16, 17, 18, 19 into positioning beam 8, but any other appropriate fastener can be used.

Figure 6:
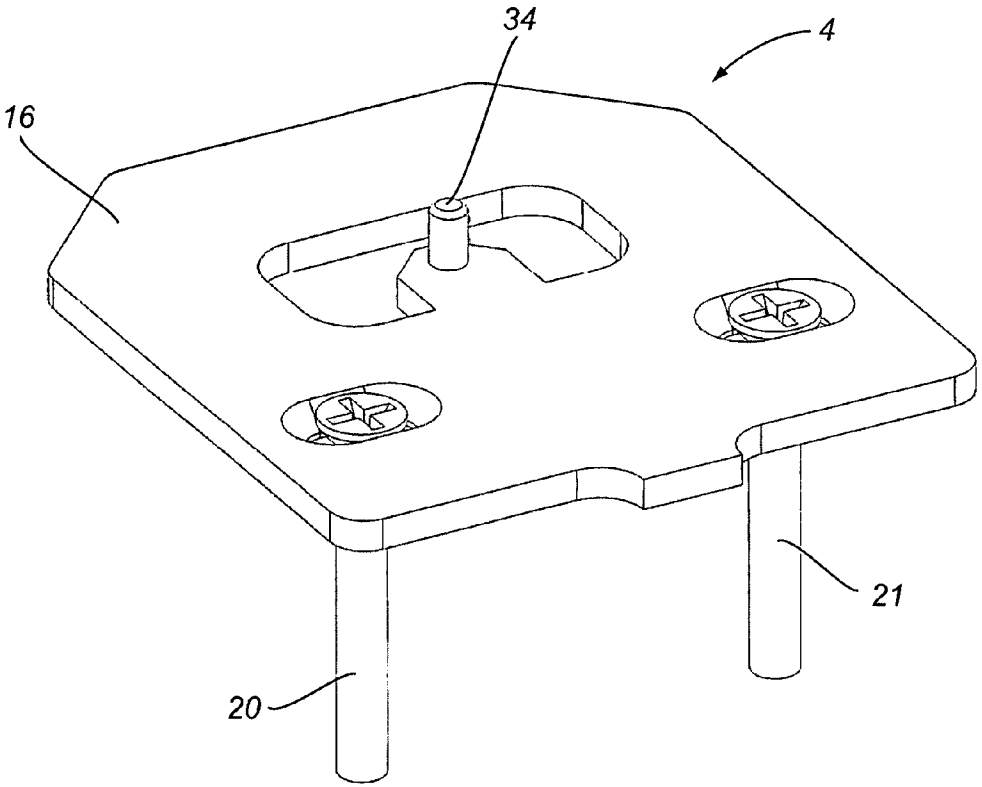
FIG. 6 is an enlarged isometric view of one of the pin plates depicted in FIG. 4.
Figure 7:
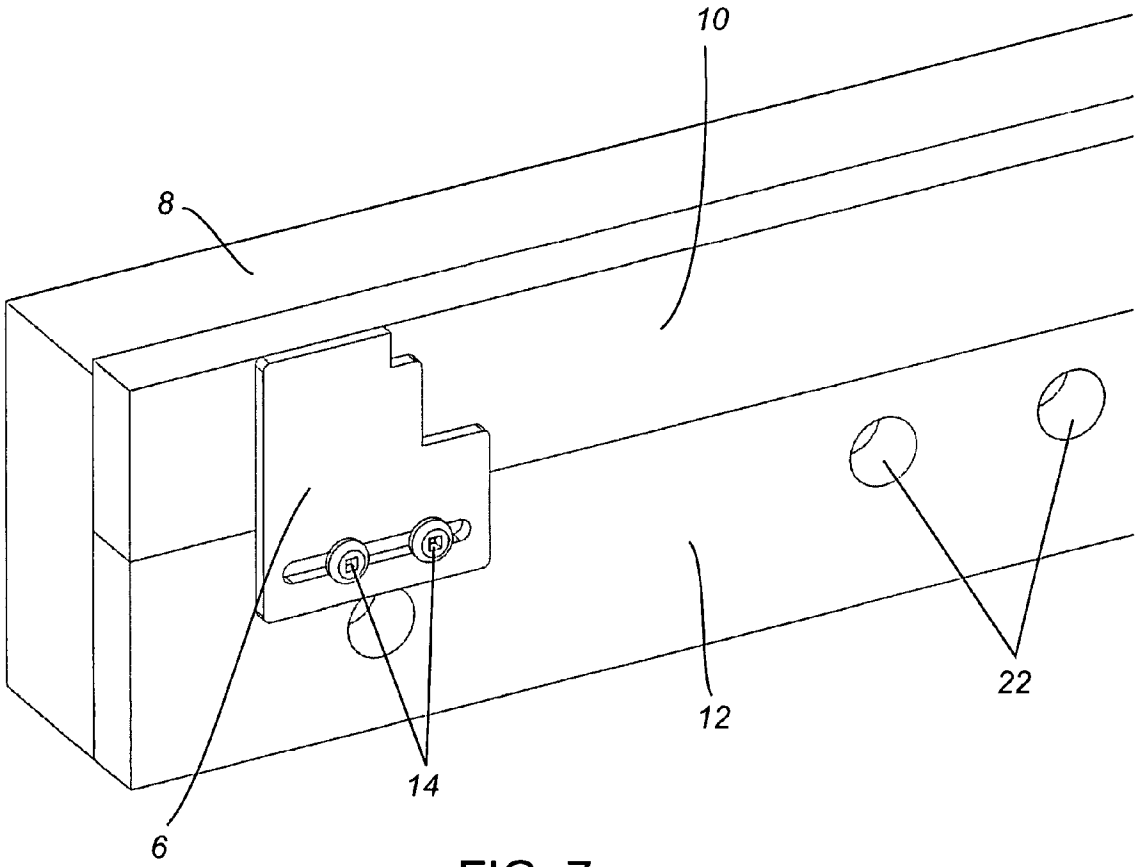
FIG. 7 is an enlarged isometric view of the side stop depicted in FIG. 1.
Figure 8:
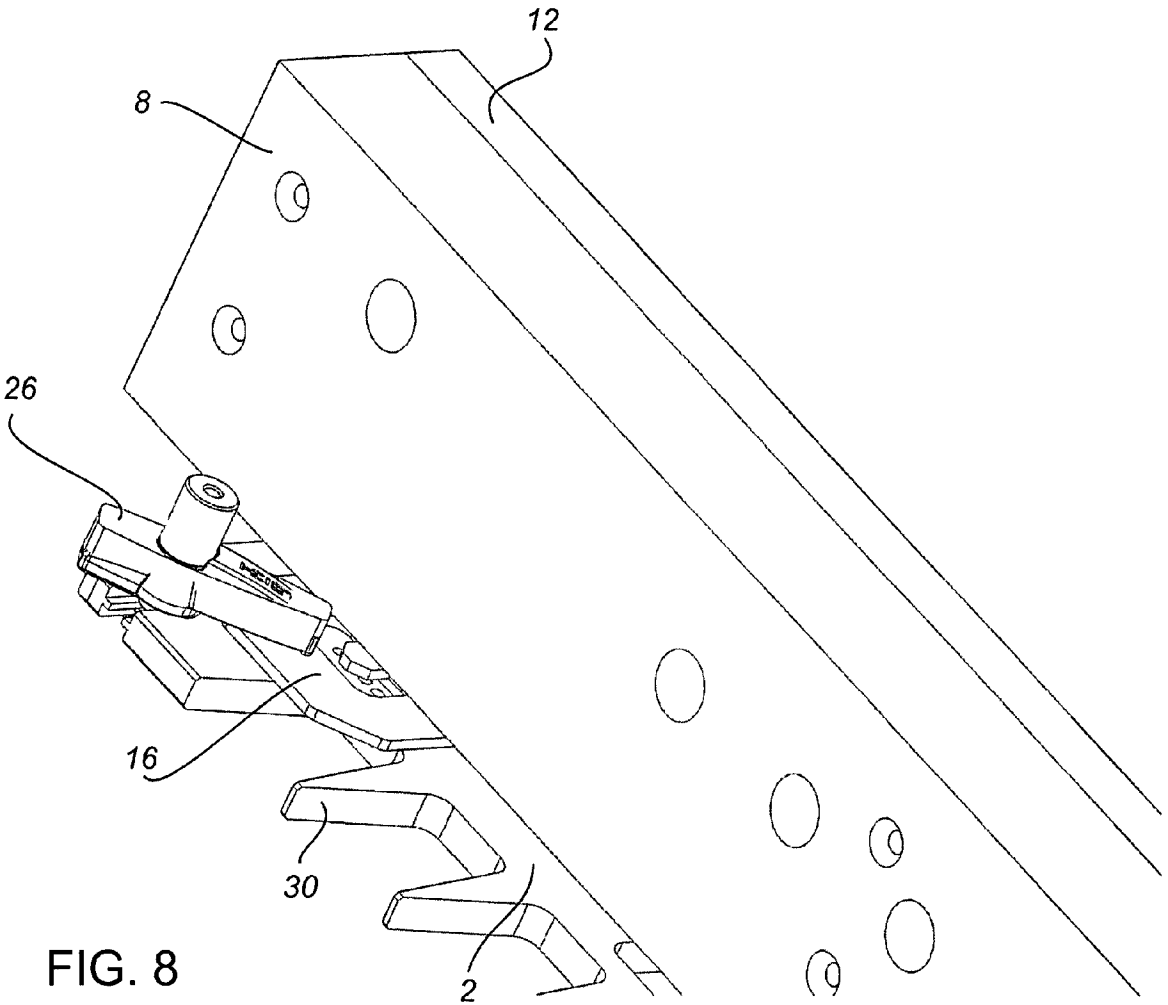
FIG. 8 is an isometric view of a portion of the underside, pin side, and an end of a locking mechanism of the embodiment depicted in FIG. 1.

Pin plates 16, 17, 18, 19 have anchoring screws 20, 21 and indexing pin 34 as depicted in FIG. 6. In some embodiments, pin plates 16, 17, 18, 19 are made of steel. In these embodiments, template 2 can be attached to one embodiment of pin plates 16, 17, 18, 19 made of steel either by powerful rare earth magnets set flush with, or just below planar surface 28, by mechanical means sliding clips, or by turn buckle clips. Indexing pin 34 retains template 2 horizontally, creating a very secure set-up that is quick and easy in use. Indexing pin 34 also provides precise Y-axis template positioning (relative to the front face of woodcutting jig 1) for routing dovetail pins. Lock 26 shown in FIG. 8 is one mechanical means of securing template 2 to the pin plates 16, 17, 18, 19.

Figure 9:
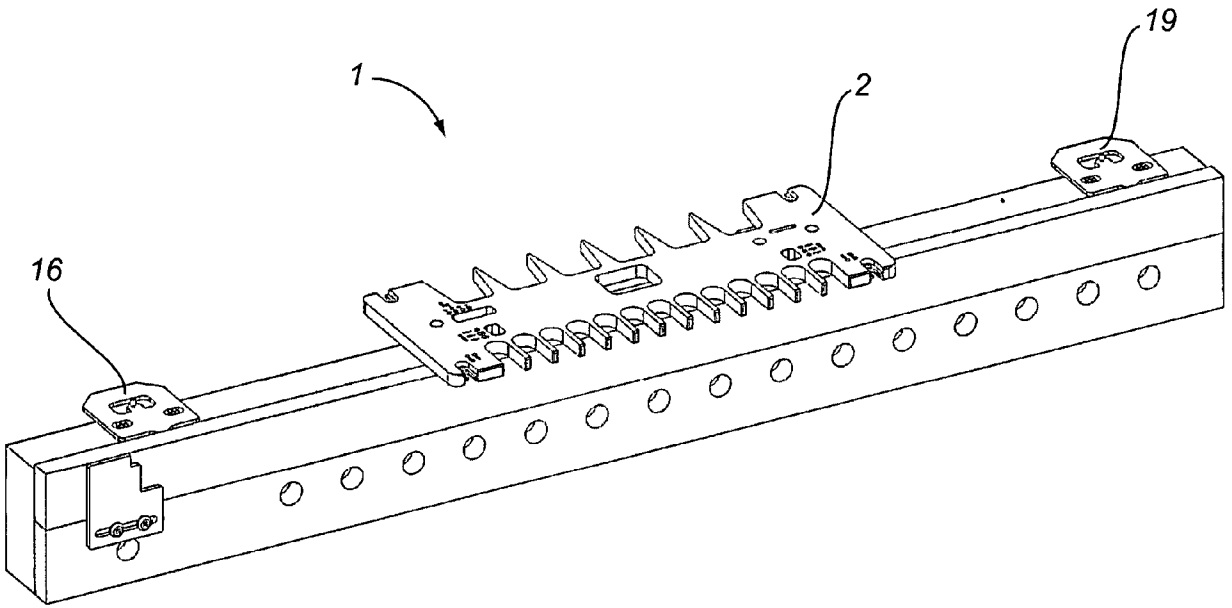
FIG. 9 is an isometric view of the tail face, top, and one end of the embodiment of the mounted woodcutting jig depicted in FIG. 1 with the template stepped over from the side stop.
Figure 11:
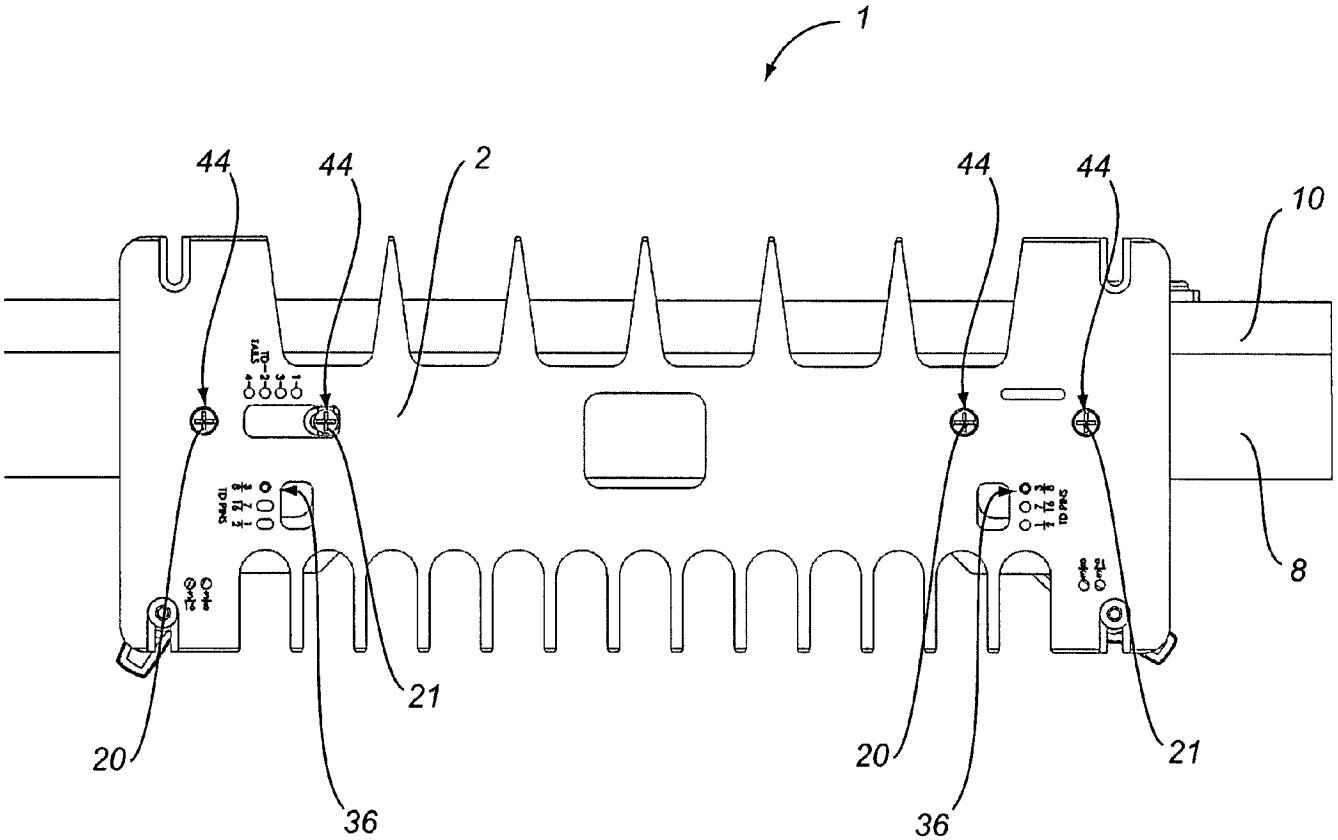
FIG. 11 is a top plan view of the woodcutting jig shown in FIG. 1 with the template positioned to set the location of the positioning members.

Template 2 may be used to establish the appropriate distance between the pin plates 16, 17, 18, 19 as depicted in FIG. 11. Pin plate 16 (not shown in FIG. 11) is positioned on positioning beam 8, and template 2 is positioned as shown in FIG. 11, with the proper location of pin plate 17 shown through template holes 36 on template 2. After pin plate 17 has been secured to beam 8, the template 2 can be stepped over, as shown in FIG. 9, to locate pin plate 18 at the appropriate distance from pin plate 17. When connected to pin plates 16 and 17, template 2 is aligned with side stop 6.

Side stop 6 has side stop screws 14 which penetrate through side stop 6 and backup board 12 into positioning beam 8 to attach side stop 6 to positioning beam 8 as depicted in FIG. 1. Further, side stop 6 orients the workpiece with respect to template 2, backup board 12, scab board 10, and positioning beam 8.

When measuring the distances between pin plates 16, 17, 18, 19, the user utilizes template holes 36 in template 2 to determine a location to insert anchoring screws 20, 21 in this embodiment. The user then "steps over" template 2, and determines the next location of the anchoring screws 20, 21.

The "step over" functionality allows template 2 to be used to cut joints into workpieces wider than template 2 because the positioning of pin plates 16, 17, 18, 19 and anchoring screws 20, 21 is provided by positioning holes 44 in template 2. The user can precisely adjust the positions of pin plates 16, 17, 18, 19. Furthermore, measuring the distance between pin plates 16, 17, 18, 19 using template 2 maintains accuracy in the pin and tail interaction despite any positioning beam expansion or contraction that may occur between uses.

Figure 4:
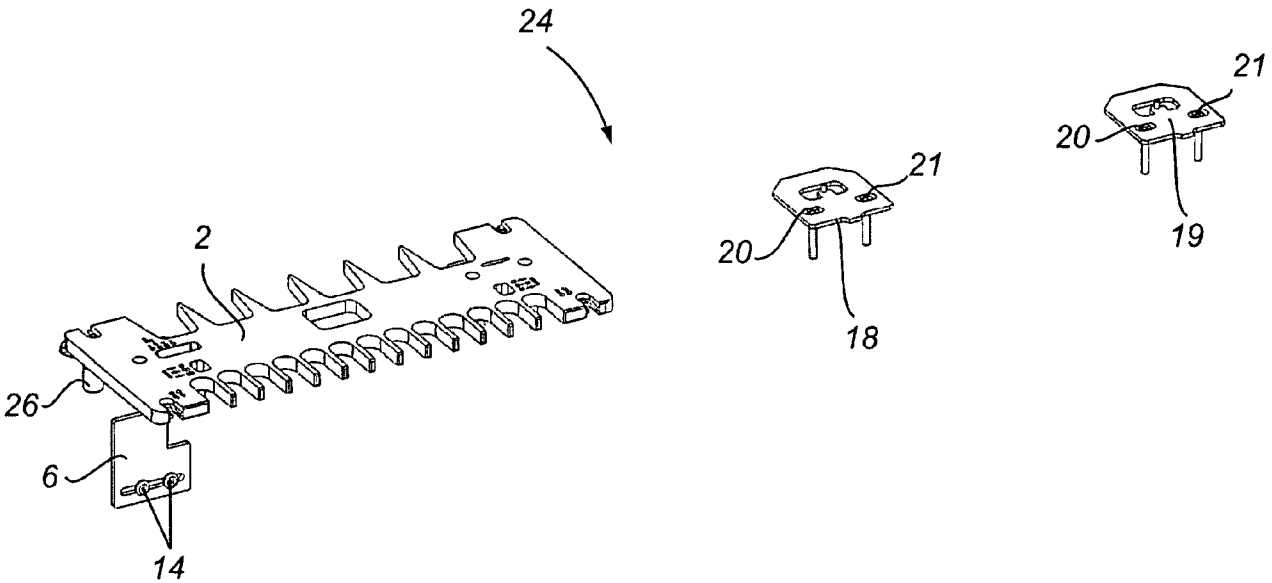
FIG. 4 is the same view of the components of the woodcutting jig kit of this invention shown in FIG. 1, but without the positioning beam, scab board, or backup board.

Components for a woodcutting jig 1 may be provided as a kit 24, depicted in FIG. 4, reducing its size and cost. Such a kit 24 may include the following components: pin plates 16, 17, 18, 19, template 2, side stop 6, at least one lock 26, and other fastening devices. Side stop screws 14 and anchoring screws 20, 21 are conventional wood screws that optionally might not necessarily be supplied with kit 24 components. Thus, the screws are not necessarily provided in the kit.

The above-described embodiments are merely illustrative of this invention. Other embodiments may be readily devised by those skilled in the art which will embody the principles of the invention and fall within the spirit and scope of the following claims.

The invention claimed is:

1. A woodcutting jig comprising (a) a template for guiding the path of a cutting tool, (b) a positioning beam, and (c) a plurality of positioning members removably attachable to the positioning beam for positioning the template in predetermined alternative locations along the beam, wherein the template is substantially shorter than the positioning beam such that the template is configured to be stepped over from a first predetermined alternative location to a second predetermined alternative location along a length of the positioning beam to facilitate cutting a piece of wood that is substantially wider than the template, wherein the template comprises a planar surface for contact with a cutting tool reference surface, and a plurality of spaced-apart fingers having at least one cutter guiding surface orthogonal to the planar surface to guide the cutting tool by contact between the cutter guiding surface and a bushing or cutter bearing, wherein when in the first predetermined alternative location, the template overlays at least two of the plurality of positioning members.

2. The woodcutting jig of claim 1, wherein the template is removably mounted to the positioning beam.

3. The woodcutting jig of claim 1, wherein the template is penetrated by pin holes for receiving pins in order to establish the location of the template on the positioning members to allow for repeatable positioning of the template with respect to the positioning beam.

4. The woodcutting jig of claim 1, wherein the positioning members comprise pin plates positioned on the positioning beam that are spaced apart a distance equal to the distance between the template pin holes.

5. The woodcutting jig of claim 4, wherein the positioning members further comprise screws that secure the positioning members to the positioning beam.

6. The woodcutting jig of claim 5, wherein the positioning members are positioned apart at a distance established by reference to the pin holes in the template.

7. The woodcutting jig of claim 1, comprising a lock to secure the template to the positioning members at the first and second positions.

8. A woodcutting jig for cutting woodworking joints comprising: (a) a dovetailing template for guiding the path of a cutting tool, (b) an elongated beam extending along a length, and at least three positioning members removably attached to the elongated beam and configured to position the template in predetermined alternative locations along the length of the beam, wherein a distance between a first and a second of the positioning members along the length of the beam is equal to a distance between the second and a third of the positioning members along the length of the beam such that when the template is in a first of the predetermined alternative locations the template is removably secured to the first and second positioning members but not the third positioning member and when the template is in a second of the predetermined alternative locations the template is removably secured to the second and third positioning members but not the first positioning member, wherein the template comprises a planar surface for contact with a cutting tool reference surface, and a plurality of spaced-apart fingers having at least one cutter guiding surface orthogonal to the planar surface to guide the cutting tool by contact between the cutter guiding surface and a bushing or cutter bearing, wherein when in the first predetermined alternative location, the template overlays at least two of the plurality of positioning members.

9. The woodcutting jig of claim 8, wherein the template is penetrated by pin holes for receiving pins in order to establish the location of the template on the positioning members to allow for repeatable positioning of the template with respect to the positioning beam.

10. The woodcutting jig of claim 9, wherein the positioning members are configured to attach to the positioning beam by screws.

11. The woodcutting jig of claim 8, further comprising a lock to secure the template to the positioning members.

12. The woodcutting jig of claim 11, wherein the lock is attachable to the template and the lock is adjustable to secure the template to a positioning member.

13. The woodcutting jig of claim 8, further comprising a stop, for attachment to the positioning board that aligns the template and the workpiece.

14. The woodcutting jig of claim 13, wherein the stop comprises a contact surface which restrains the movement of the workpiece in a lateral direction.

15. The woodcutting jig of claim 13, wherein the stop is penetrated by screw holes for receiving screws in order to secure the location of the stop on the positioning beam.

16. The woodcutting jig of claim 1, wherein the template is further configured to be positioned in predetermined alternative locations relative to a width of the beam.

17. The woodcutting jig of claim 16, wherein either the template or the positioning members comprise a series of holes configured to facilitate positioning the template in the predetermined alternative locations relative to the width of the beam.

18. The woodcutting jig of claim 8, wherein the template is further configured to be positioned in predetermined alternative locations relative to a width of the beam.

* * * * *